US011767718B2

(12) United States Patent
Toniolo et al.

(10) Patent No.: US 11,767,718 B2
(45) Date of Patent: Sep. 26, 2023

(54) HYDRAULIC DOWNHOLE TOOL DECELERATOR

(71) Applicant: Schlumberger Technology Corporation, Sugar Land, TX (US)

(72) Inventors: Julien Toniolo, Houston, TX (US); Simon Mattias Flander, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 17/379,115

(22) Filed: Jul. 19, 2021

(65) Prior Publication Data

US 2022/0195814 A1 Jun. 23, 2022

Related U.S. Application Data

(60) Provisional application No. 63/126,769, filed on Dec. 17, 2020.

(51) Int. Cl.
*E21B 17/07* (2006.01)
*E21B 23/04* (2006.01)

(52) U.S. Cl.
CPC ..... *E21B 17/07* (2013.01); *E21B 23/0413* (2020.05)

(58) Field of Classification Search
CPC ..... E21B 17/07; E21B 23/0413; E21B 23/04
See application file for complete search history.

(56) References Cited

U.S. PATENT DOCUMENTS 3,301,410 A 1/1967 Elwyn
4,413,516 A * 11/1983 Croom, Jr. ..... E21B 47/017 73/431

(Continued)

FOREIGN PATENT DOCUMENTS

CA 2314192 A1 3/2001
CA 2860533 A1 7/2013

(Continued)

OTHER PUBLICATIONS

Jiao S, Tian J, Zheng H, Hua H. Modeling of a hydraulic damper with shear thinning fluid fordamping mechanism analysis. Journal of Vibration and Control. Dec. 2017; 23(20):3365-3376. doi:10.1177/1077546316629264 (Year: 2017).*

(Continued)

*Primary Examiner* — Nicole Coy
*Assistant Examiner* — Nicholas D Wlodarski
(74) *Attorney, Agent, or Firm* — Frederick Carbone

(57) ABSTRACT

Embodiments described herein provide systems and methods for minimizing deceleration of downhole tools when the downhole tools are pumped down into wellbores through drill pipe in an untethered manner. For example, embodiments described herein include a hydraulic downhole tool deceleration system that includes a hydraulic decelerator configured to be affixed to a downhole tool string pumped down through drill pipe during operation. The hydraulic decelerator is configured to contact a hard shoulder while traveling through the drill pipe, and to limit an initial magnitude of deceleration of the downhole tool string caused at the initial moment of contact of the hydraulic decelerator against the hard shoulder.

16 Claims, 8 Drawing Sheets

(56) References Cited

U.S. PATENT DOCUMENTS

| | | | | |
|---|---|---|---|---|
| 4,693,317 | A | 9/1987 | Edwards et al. | |
| 4,817,710 | A | 4/1989 | Edwards et al. | |
| 4,932,471 | A * | 6/1990 | Tucker | E21B 47/017 267/125 |
| 5,083,623 | A | 1/1992 | Barrington | |
| 5,183,113 | A | 2/1993 | Leaney et al. | |
| 7,044,219 | B2 | 5/2006 | Mason et al. | |
| 8,256,516 | B2 | 9/2012 | Rodgers | |
| 9,033,038 | B2 * | 5/2015 | Hetz | E21B 47/16 166/250.17 |
| 2020/0408049 | A1 | 12/2020 | Sandhu | |
| 2020/0408053 | A1 | 12/2020 | Sandhu | |

FOREIGN PATENT DOCUMENTS

| | | | |
|---|---|---|---|
| WO | 2000005482 | A1 | 2/2000 |
| WO | 2009120573 | A1 | 10/2009 |
| WO | 2013059327 | A1 | 4/2013 |

OTHER PUBLICATIONS

Substantive Exam issued in Saudi Arabia Patent Application No. 121420921 dated May 29, 2023, 9 pages with English translation.

* cited by examiner

HYDRAULIC DOWNHOLE TOOL DECELERATOR

CROSS REFERENCE PARAGRAPH

This application claims the benefit of U.S. Provisional Application No. 63/126,769, entitled "Hydraulic Dowhole Tool Decelerator," filed Dec. 17, 2020, the disclosure of which is hereby incorporated herein by reference.

BACKGROUND

The present disclosure generally relates to systems and methods for minimizing deceleration of downhole tools when the downhole tools are pumped down into wellbores through drill pipe in an untethered manner.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as an admission of any kind.

In the area of downhole tool conveyance, traditional methods include tethering the downhole tool to wireline or slickline cables, or to rigid pipe such as coiled tubing or segmented drill pipe. In the case of wireline or slickline conveyance in non-vertical wells, due the flexible nature of the wireline or slickline, it may become difficult to push the downhole tool along a horizontal or toe-up hole. If the downhole tool is conveyed through pipe that has an annular return path to the surface (such as a wireline logging tool conveyed through drill pipe), this limitation can be overcome by pumping fluid into the drill pipe to push the downhole tool along the non-vertical section of the well in an untethered manner, taking advantage of fluid drag to propel the downhole tool forward. However, one limitation of this method is that conveying downhole tools through drill pipe in an untethered manner may require that the downhole tools contact certain hard stops to stop the downhole tools at particular downhole locations, which can lead to relatively high, as well as uncontrollable, impact forces.

SUMMARY

A summary of certain embodiments described herein is set forth below. It should be understood that these aspects are presented merely to provide the reader with a brief summary of these certain embodiments and that these aspects are not intended to limit the scope of this disclosure.

Certain embodiments of the present disclosure include a hydraulic downhole tool deceleration system that includes a hydraulic decelerator configured to be affixed to a downhole tool string pumped down through drill pipe during operation. The hydraulic decelerator is configured to contact a hard shoulder while traveling through the drill pipe, and to limit an initial magnitude of deceleration of the downhole tool string caused at the initial moment of contact of the hydraulic decelerator against the hard shoulder.

Various refinements of the features noted above may be undertaken in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings, in which.

DETAILED DESCRIPTION

One or more specific embodiments of the present disclosure will be described below. These described embodiments are only examples of the presently disclosed techniques. Additionally, to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

As used herein, the terms "connect," "connection," "connected," "in connection with," and "connecting" are used to mean "in direct connection with" or "in connection with via one or more elements"; and the term "set" is used to mean "one element" or "more than one element." Further, the terms "couple," "coupling," "coupled," "coupled together," and "coupled with" are used to mean "directly coupled together" or "coupled together via one or more elements." As used herein, the terms "up" and "down," "uphole" and "downhole," "upper" and "lower," "top" and "bottom," and other like terms indicating relative positions to a given point or element are utilized to more clearly describe some elements. Commonly, these terms relate to a reference point as the surface from which drilling operations are initiated as being the top (e.g., uphole or upper) point and the total depth along the drilling axis being the lowest (e.g., downhole or lower) point, whether the well (e.g., wellbore, borehole) is vertical, horizontal or slanted relative to the surface.

Figure 1A:
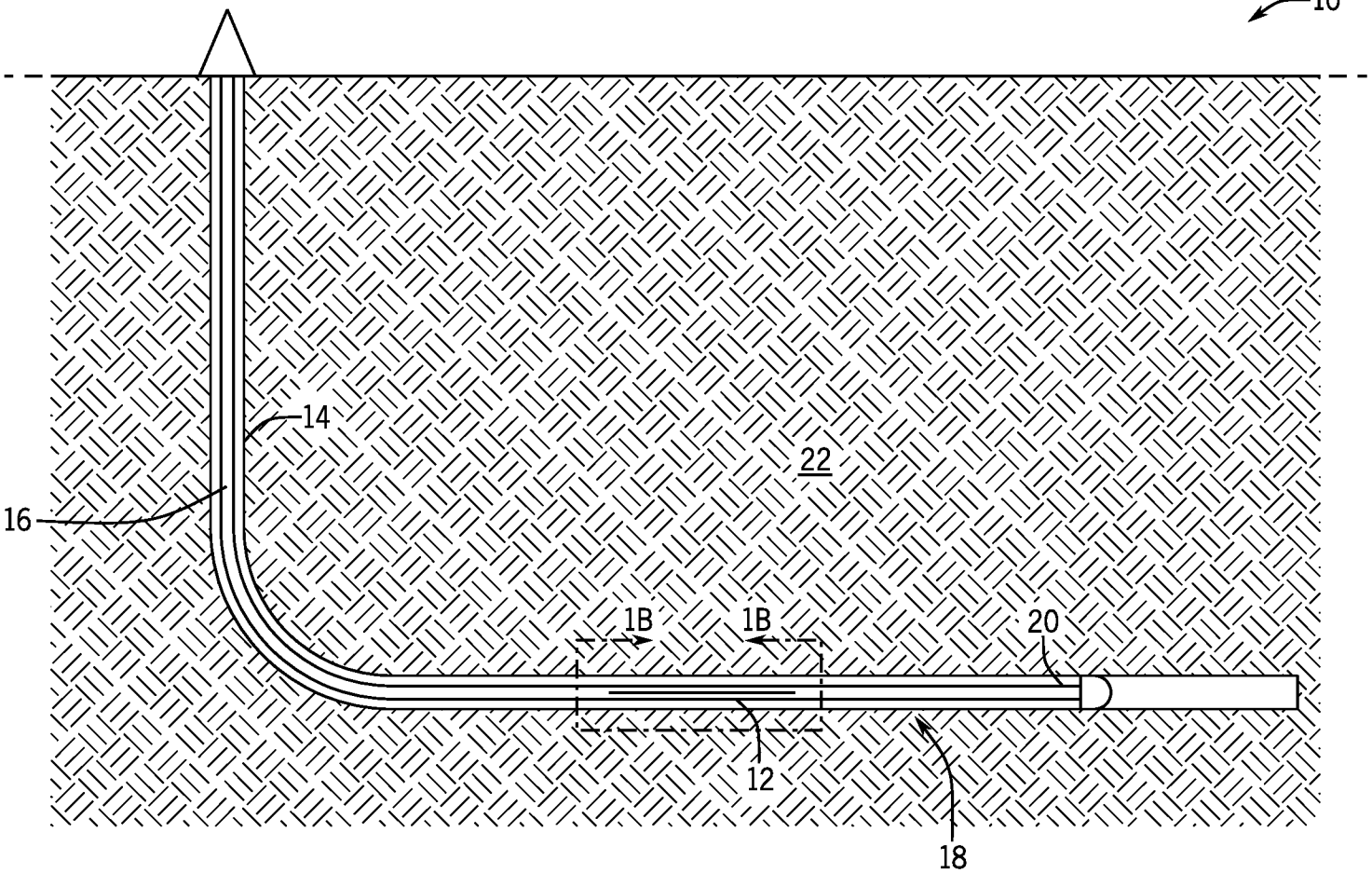
FIGS. 1A and 1B illustrate a well within which a downhole tool (e.g., such as a logging tool) is conveyed down into a wellbore via pump down conveyance methods, in accordance with embodiments of the present disclosure.
Figure 1B:
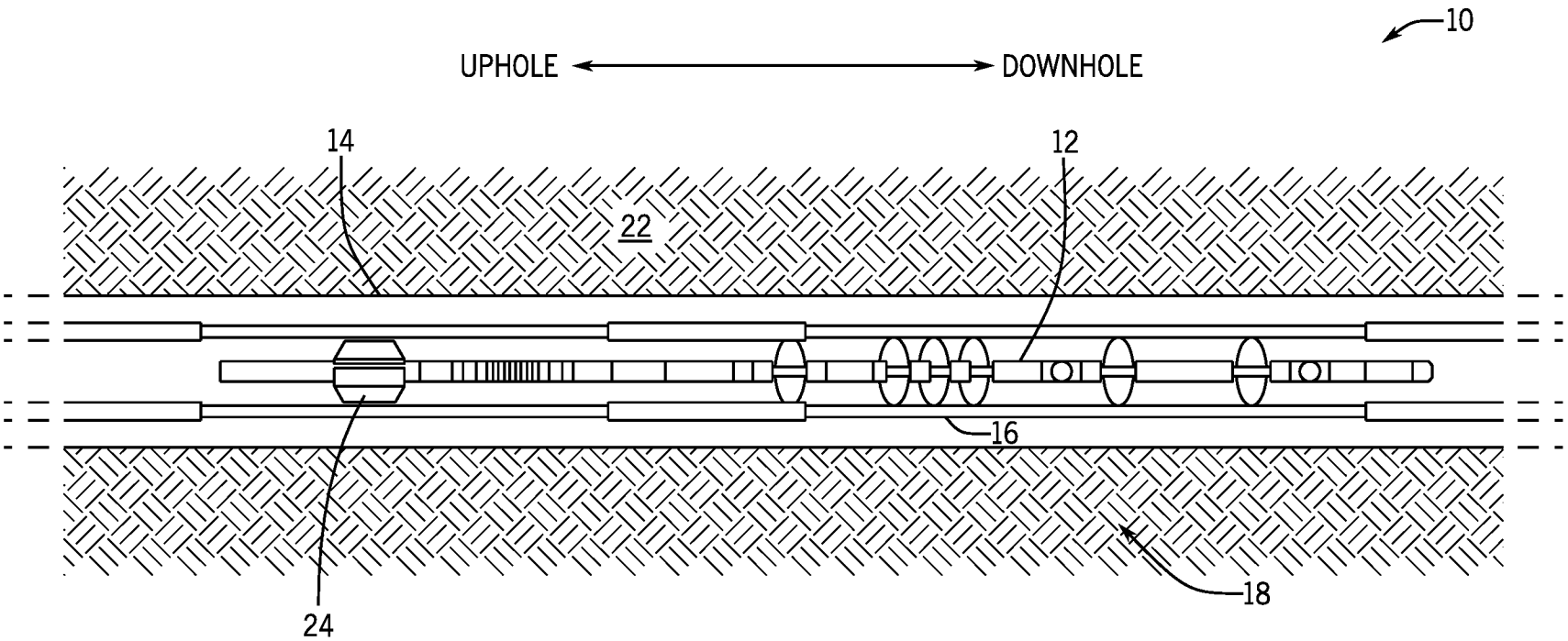

FIGS. 1A and 1B illustrate a well 10 within which a downhole tool string 12 (e.g., such as a logging tool string) is conveyed down into a wellbore 14 via pump down conveyance methods whereby, for example, a fluid flowing through drill pipe 16 is used to provide the motive force to drive the downhole tool string 12 through the wellbore 14, particularly in non-vertical sections 18 of the wellbore 14. As illustrated, in certain embodiments, a reaming bottom hole assembly (BHA) 20 may be used to form the wellbore 14 through a subterranean formation 22. As described in greater detail herein, a hydraulic decelerator 24 may be used to slow the downhole tool string 12 down (e.g., gradually decelerate) the downhole tool string 12 when the hydraulic decelerator 24 contacts a hard shoulder 26 (e.g., a landing ring) of the drill pipe 16 within which the downhole tool string 12 is conveyed. As such, the hydraulic decelerator 24 described herein reduces the shock of impact when the hydraulic decelerator 24 contacts the hard shoulder 26.

Figure 2:
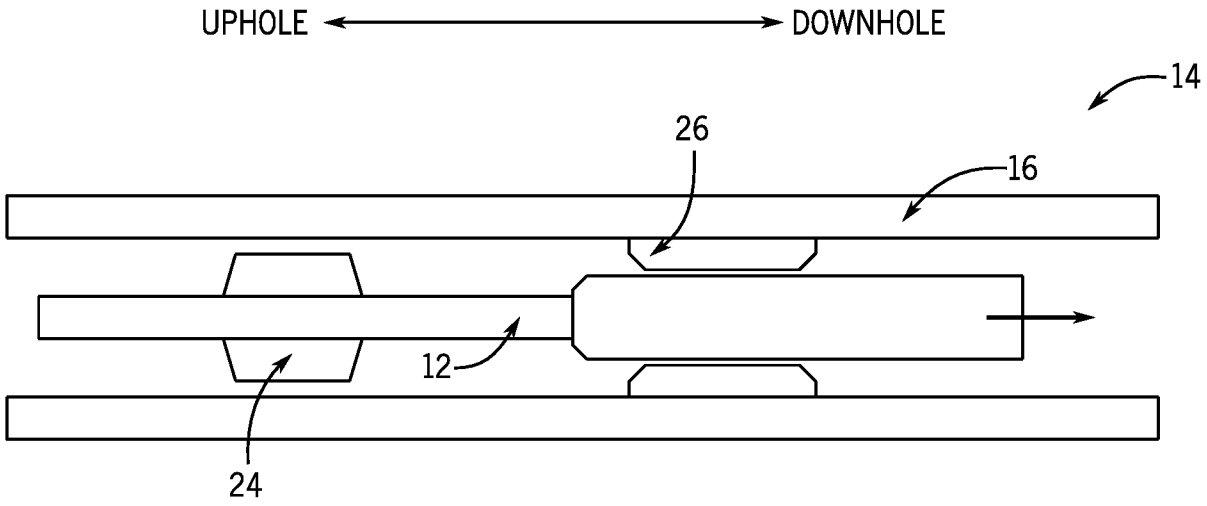
FIG. 2 is a cutaway side view of a portion within a wellbore illustrating a downhole tool string travelling downhole through drill pipe, in accordance with embodiments of the present disclosure.

For example, FIG. 2 is a cutaway side view of a portion within a wellbore 14 illustrating the downhole tool string 12 travelling downhole (e.g., to the right) through the drill pipe 16. As illustrated, in certain embodiments, the hydraulic decelerator 24 may be affixed to the downhole tool string 12, for example, radially about an outer diameter (e.g., outer surface) of the downhole tool string 12, and may extend radially from the downhole tool string 12 such that when the hydraulic decelerator 24 axially reaches the hard shoulder 26 of the drill pipe 16, the hydraulic decelerator 24 may contact the hard shoulder 26, causing both the hydraulic decelerator 24 and the downhole tool string 12 to eventually come to a stop whereby the hydraulic decelerator 24 and the downhole tool string 12 move no further axially relative to the hard shoulder 26 within the drill pipe 16. As described in greater detail herein, the hydraulic decelerator 24 is configured to ensure that the rate at which the downhole tool string 12 decelerates relative to the hard shoulder 26 substantially reduces the shock of the impact of the hydraulic decelerator 24 against the hard shoulder 26, thereby substantially reduces any potential negative impact on the components of the downhole tool string 12.

In conventional techniques, often, a wireline cable is used to control the deployment of the downhole tool string 12 down through drill pipe 16 by using winch data, for example, to verify the downhole tool string 12 is being effectively pumped down, monitoring speed and position during descent, and slowing down the downhole tool string 12 before reaching a no-go landing ring, for example. In addition, in such conventional techniques, the wireline cable may verify proper deployment using telemetry lines of the wireline cable (e.g., tool face and tool responses), may activate a density tool caliper using the telemetry lines of the wireline cable, may verify proper functioning of the downhole tool string 12, may release the downhole tool string 12 (e.g., using telemetry and power lines of the wireline cable), and may optionally retrieve the downhole tool string 12 after logging interval data has been acquired.

In contrast, the embodiments described herein enable the downhole conveyance of the downhole tool string 12 without the use of a wireline cable (or other tethered solution), for example, by pumping the downhole tool string 12 downhole through drill pipe 16 using fluid pumped down through the drill pipe 16 (as described with reference to FIGS. 1A and 1B). Providing an untethered service (e.g., with no wireline cable connected to the downhole tool string 12) presents the challenge of re-engineering the functionality of the conventional use of wireline cables described above. The embodiments described herein focus on the ability to slow the downhole tool string 12 before landing on a no-go (e.g., hard stop or hard shoulder 26) in a drill collar of drill pipe 16 (e.g., when the downhole tool string 12 has reached its target depth).

In particular, without the deceleration provided by a wireline tether, the downhole tool string 12 may otherwise impact the no-go (e.g., hard stop or hard shoulder 26) in a drill collar of drill pipe 16 at velocities exceeding 6 feet/second. For a downhole tool string 12 that may weigh as much as 1,000 pounds, this may create a relatively large impact force when the downhole tool string 12 suddenly impacts a rigid hard stop such as the no-go (e.g., hard stop or hard shoulder 26) in a drill collar of drill pipe 16. The resulting shock could easily damage mechanical components, as well as electronics, of the downhole tool string 12. To prevent this, the embodiments described herein slow the downhole tool string 12 down and dissipate energy from the impact in a more controlled manner. In particular, the embodiments described herein provide a hydraulic decelerator 24 that utilizes hydraulic methods of achieving gradual deceleration of the downhole tool string 12. For example, as described in greater detail herein, the hydraulic decelerator 24 may limit an initial magnitude of deceleration of the downhole tool string 12 caused at an initial moment of contact of the hydraulic decelerator 24 against the no-go (e.g., hard stop or hard shoulder 26) while traveling at a first speed, and/or vary a rate of deceleration of the downhole tool string 12 over time after the initial moment of contact of the hydraulic decelerator 24 against the no-go (e.g., hard stop or hard shoulder 26) until ending at a second speed.

Figure 3:
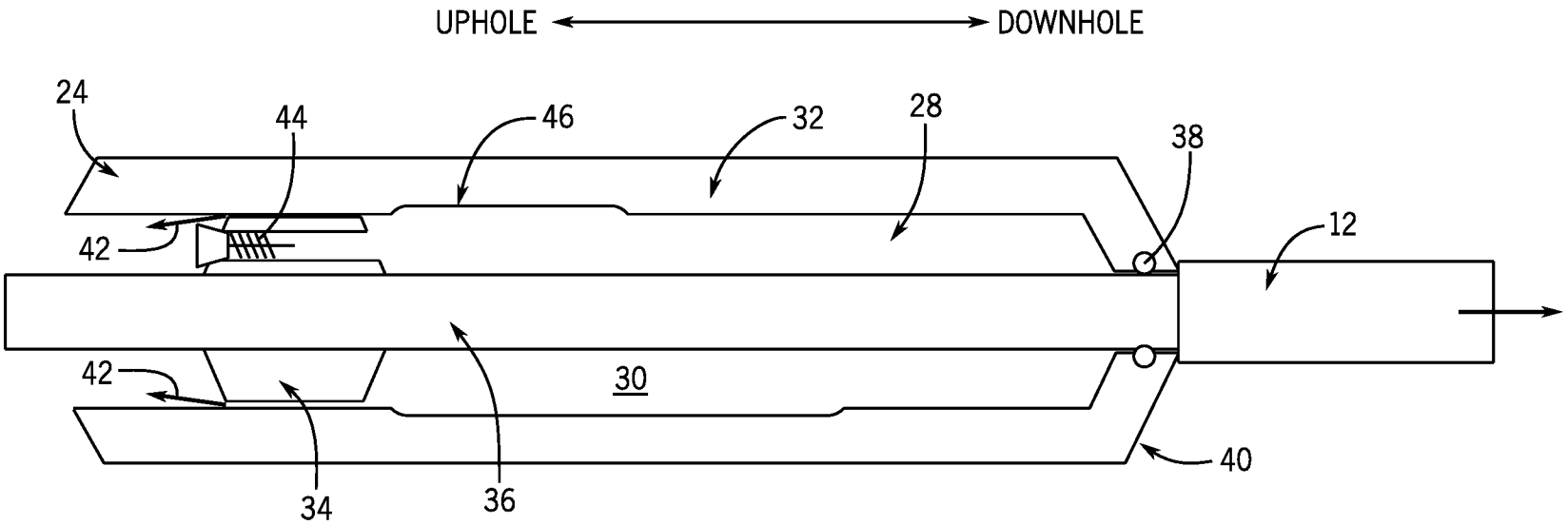
FIG. 3 is a cutaway side view of a purely hydraulic decelerator coupled to a downhole tool string, in accordance with embodiments of the present disclosure.

One possible approach to decelerate the downhole tool string 12 is a purely hydraulic decelerator 24. FIG. 3 is a cutaway side view of a purely hydraulic decelerator 24 coupled to a downhole tool string 12. As illustrated in FIG. 3, in certain embodiments, a hydraulic fluid 28 having known fluid properties may be trapped within an internal annular hydraulic chamber 30 formed between an outer sleeve 32 of the hydraulic decelerator 24 and the downhole tool string 12, wherein the hydraulic fluid 28 is isolated from drilling mud within the drill pipe 16 by a piston 34 affixed to a central shaft 36 of the downhole tool string 12, which is untethered, as described in greater detail herein. In addition, in certain embodiments, a sealing ring (e.g., o-ring) 38 may be used between the outer sleeve 32 and the downhole tool string 12 to further isolate the hydraulic fluid 28 from the drilling mud within the drill pipe 16. Furthermore, in certain embodiments, the outer sleeve 32 may be directly coupled to the central shaft 36 of the downhole tool string 12 (e.g., via one or more shear devices, one or more tensile weak points, a coiled spring, and so forth) prior to impact to prevent inadvertent action of the piston 34 relative to the outer sleeve 32. In such embodiments, the force of impact will cause the outer sleeve 32 to become decoupled from the central shaft 36 of the downhole tool string 12.

Initially, during pump-down conveyance, the hydraulic chamber 30 is filled with the hydraulic fluid 28 of a known viscosity (oil, grease, etc.) and isolated (e.g., hermetically sealed off) from an exterior of the hydraulic decelerator 24. When a downhole axial end 40 of the outer diameter of the outer sleeve 32 impacts a no-go (e.g., hard stop or hard shoulder 26) at the target depth in the drill pipe 16 (see, e.g., FIG. 2), the annular volume of the hydraulic chamber 30 rapidly decreases as the outer sleeve 32 slides uphole axially relative to the piston 34, which is affixed to the downhole tool string 12. This generates a relatively large increase in hydraulic pressure inside the hydraulic chamber 30, which causes at least a portion of the hydraulic fluid 28 to flow through an annular space formed between an outer diameter of the piston 34 and an inner diameter (e.g., inner surface) of the outer sleeve 32, as illustrated by arrows 42. The relatively viscous hydraulic fluid 28 dissipates the kinetic energy of the initial impact until the outer sleeve 32 shoulders against the fixed piston 34, at which point the downhole tool string 12 has slowed to a near stop. In certain embodiments, a pressure relief valve 44 may be used to equalize the pressure within the hydraulic chamber 30 and outside of the hydraulic chamber 30 to compensate for thermal expansion of the hydraulic fluid 28.

In addition, in certain embodiments, internal grooves 46 on the inner diameter of the outer sleeve 32 may be added so that the annular volume between the piston 34 and the outer sleeve 32 may be varied as a function of axial position of the piston 34 within the outer sleeve 32, thereby providing metering of the amount of hydraulic fluid 28 that is pushed past the piston 34 over time as the piston 34 moves downhole axially relative to the outer sleeve 32 (e.g., during impact with the hard stop or hard shoulder 26 illustrated in FIG. 2). In certain embodiments, the internal grooves 46 (or scalloped cuts) may be replaced by a tapered housing.

In general, the energy absorbed during the process can be tuned by any combination of one more of the following: (1) varying the properties and the volume of the hydraulic fluid 28 within the hydraulic chamber 30, (2) varying the opening threshold of the pressure relief valve 44, (3) varying the flow area of the metered hydraulic fluid 28 allowed to flow between the outer diameter of the piston 34 and the inner diameter of the outer sleeve 32, (4) varying the cross sectional area of the annular space formed within the hydraulic chamber 30, and (5) varying the number, shape, and length of the orifices (e.g., formed between the outer diameter of the piston 34 and the inner diameter of the outer sleeve 32, and varied as a function of axial offset position between the piston 34 and the outer sleeve 32 by the internal grooves 46). As described in greater detail herein, the orifices (e.g., formed between the outer diameter of the piston 34 and the inner diameter of the outer sleeve 32) may be formed by internal grooves 46 on the inner diameter of the outer sleeve 32. However, in other embodiments, the orifices may instead by formed by grooves on an outer diameter of the piston. Regardless, the orifices are gaps that create relatively large pressure drops (e.g., due to viscous losses) that create a reaction force on the piston 34 that decelerates the downhole tool string 12.

In general, at initial impact, the velocity of the hydraulic fluid 28 is at its maximum, and the resulting deceleration force is generally proportional to the square of the velocity of the hydraulic fluid 28. As the kinetic energy is dissipated, the velocity of the hydraulic fluid 28 decreases and, therefore, so does the deceleration force. This means that if the annular space formed within the hydraulic chamber 30 and orifice cross section remain relatively constant through the entire displacement of the outer sleeve 32, nearly all the deceleration still happens at the moment of impact, producing a relatively large spike in force, which may be undesirable (see, e.g., FIG. 4). This type of fixed annular volume design is analogous to what people in the business of designing shock absorbers call "fixed orifice metering".

Figure 4:
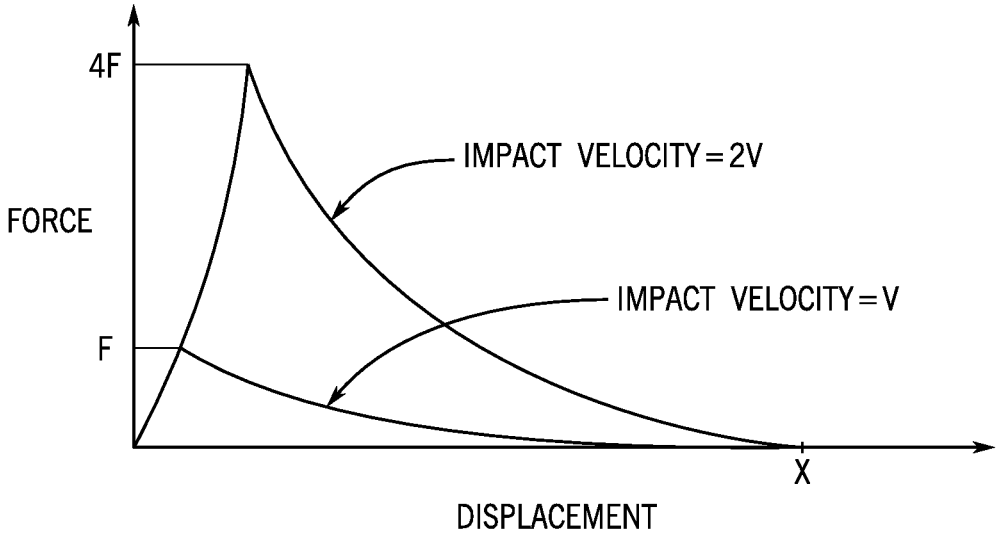
FIG. 4 illustrates force versus displacement curves, in accordance with embodiments of the present disclosure.
Figure 5:
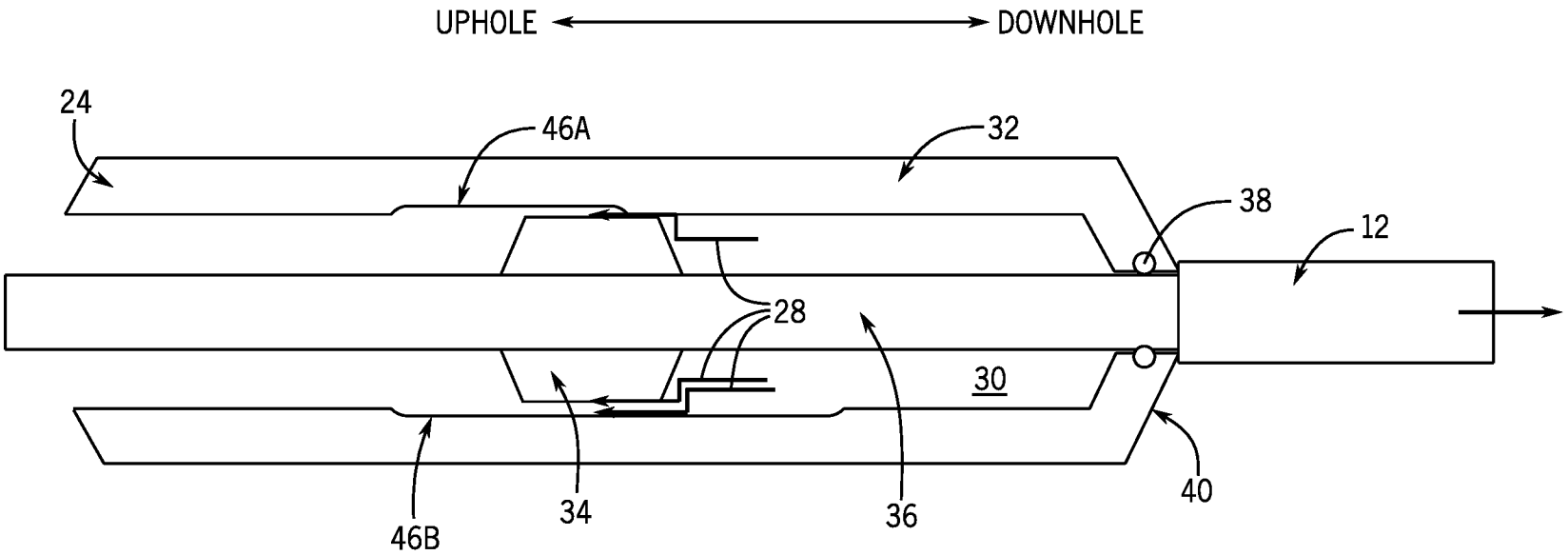
FIG. 5 is a cutaway side view of a variable fluid metering hydraulic decelerator coupled to a downhole tool string, in accordance with embodiments of the present disclosure.

In certain embodiments, to avoid such relatively high initial shock, the annular space and orifice cross section may instead be relatively large in the beginning of the stroke (e.g., at initial impact), and then decrease as the outer sleeve 32 strokes (e.g., moves uphole axially relative to the piston 34) to result in a flatter deceleration vs displacement curve than illustrated in FIG. 4. In certain embodiments, this may be achieved by strategically adding internal grooves 46 of varying lengths to the inside of the outer sleeve 32. FIG. 5 is a cutaway side view of a variable fluid metering hydraulic decelerator 24 coupled to a downhole tool string 12. As illustrated in FIG. 5, a first internal groove 46A and a second internal groove 46B may, for example, be disposed on opposite radial side of the inner diameter of the outer sleeve 32, starting roughly at a same axial location along the inner diameter of the outer sleeve 32. However, the second internal groove 46B may be axially longer than the first internal groove 46A such that both internal grooves 46A, 46B add annular area to the orifice at the beginning of the stroke (e.g., at initial impact), but only the longer internal groove 46B adds annular area to the orifice once the piston 34 passes the downhole axial end of the shorter internal groove 46A.

In certain embodiments, a similar effect may be achieved by instead tapering the internal diameter of the outer sleeve 32 such that the annular area is at its largest at the beginning of the stroke (e.g., at initial impact), and then decreases as the outer sleeve 32 strokes (e.g., moves uphole axially relative to the piston 34). For example, in such embodiments, the internal grooves 46 may create an inner diameter of the outer sleeve 32 that is largest at the beginning of the stroke (e.g., at initial impact), but then decreases (e.g., either linearly or non-linearly) along an axially downhole direction of the outer sleeve 32. In addition, in certain embodiments, the initial force spike may be decreased at the beginning of the stroke using a hydraulic fluid 28 with shear-thinning properties. For example, in certain embodiments, the hydraulic fluid 28 may have an apparent kinetic viscosity that decreases as shear rate increases (i.e., at relatively high fluid velocities).

In general, the energy dissipation is produced by the viscous losses from the hydraulic fluid 28. If the viscosity of the hydraulic fluid 28 drops too much at relatively high temperatures, the viscous loss may not be sufficient at landing, and part of the initial energy will still be present at the end of the stroke, such that a relatively large shock of impact may result. As such, in certain embodiments, in order to ensure proper functioning of the hydraulic decelerator 24, the distance of the stroke may be increased and/or a hydraulic fluid 28 may be used whereby its viscosity does not decrease too much at relatively high temperatures. In particular, the hydraulic fluid 28 may have a relatively low coefficient of viscosity change when the temperature of the hydraulic fluid 28 increases. For example, in certain embodiments, the kinetic viscosity of the hydraulic fluid 28 at 175° C. may be greater than 0.1 times the kinetic viscosity of the hydraulic fluid 28 at 25° C.

In addition, in certain embodiments, the total flow area of variable metering between the inner diameter of the outer sleeve 32 and the piston 34 (e.g., created by the variable length internal grooves 46A, 46B or the tapered grooves described above) may also be adjusted for the weight of the downhole tool string 12 by adding additional fixed orifices to the piston 34, which may be plugged off to tune the deceleration.

During a deceleration event (e.g., after initial impact, while energy of the impact is being dissipated by the hydraulic decelerator 24), the pressure in the hydraulic chamber 30 increases and compressibility of the hydraulic fluid 28 helps to flatten the deceleration curve illustrated in FIG. 4. In addition, during a deceleration event, the initial high speed increases the shear rate and the thinning effect decreases the kinetic viscosity of the hydraulic fluid 28, which decreases the viscous losses across the orifice or gaps, further flattening the deceleration curve illustrated in FIG. 4. In addition, during a deceleration event, even with diminishing speed of the outer sleeve 32, the viscous losses are kept relatively high thanks to the narrowing of the gaps and orifices, further flattening the deceleration curve illustrated in FIG. 4.

The embodiments described above have been described in the context of methods of operating the hydraulic decelerator 24 for a single tool landing, which may then be reset to its starting position and re-filled with hydraulic fluid 28 at the surface of the well 10 before the downhole tool string 12 may be run into the drill pipe 16 again (see, e.g., FIGS. 1A and 1B). However, in certain embodiments, the requirement of manually resetting the hydraulic decelerator 24 at the surface of the well 10 may be eliminated using a return spring 48 and allowing the hydraulic fluid 28 to flow into a second hydraulic chamber (e.g., on an uphole axial side of the piston 34 opposite the hydraulic chamber 30, which is on a downhole axial side of the piston 34) rather than being bled into the drill pipe 16, as in the embodiments illustrated in FIGS. 3 and 5. In certain embodiments, the return spring 48 may be preloaded to compensate for friction between the outer sleeve 32 and the downhole tool string 12.

Figure 6:
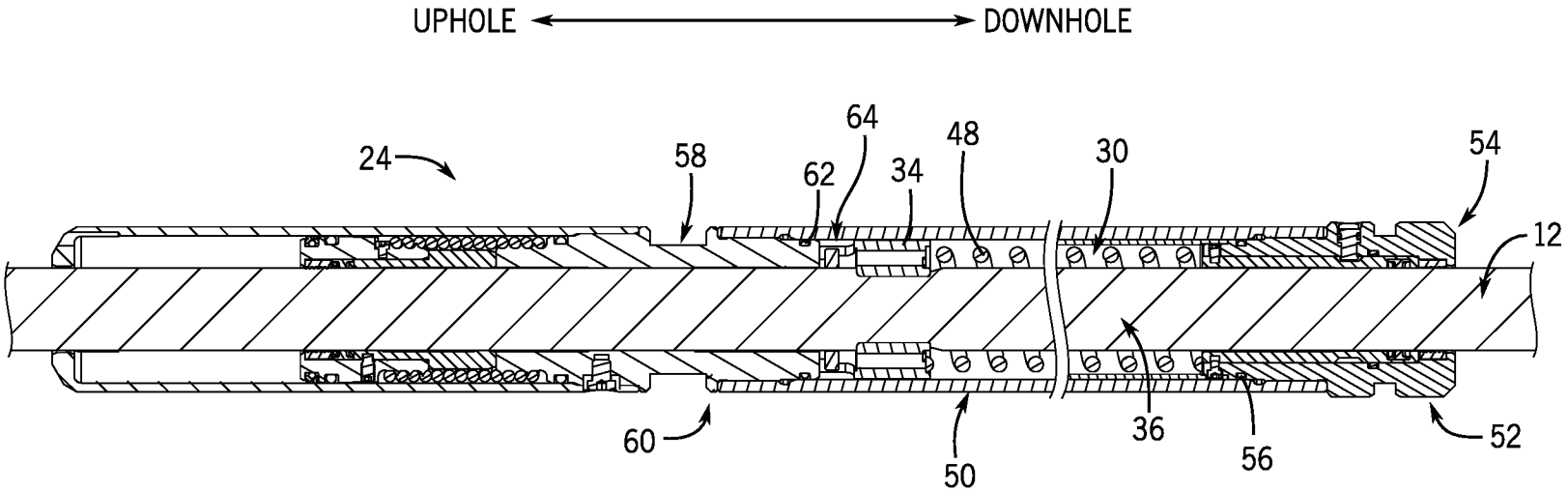
FIG. 6 is a cutaway side view of a hydraulic decelerator coupled to a downhole tool string and having a return spring disposed within a spring housing (e.g., outer sleeve) and configured to automatically reset the hydraulic decelerator, in accordance with embodiments of the present disclosure.

FIG. 6 is a cutaway side view of a hydraulic decelerator 24 coupled to a downhole tool string 12 and having a return spring 48 disposed within a spring housing 50 (e.g., outer sleeve) and configured to automatically reset the hydraulic decelerator 24 to its original state after the hydraulic decelerator 24 has experienced a first impact against a hard stop or hard shoulder 26, for example, as illustrated in FIG. 2. As illustrated in FIG. 6, the return spring 48 is disposed within the spring housing 50 axially between the piston 34 and a landing cap 52 disposed on a downhole axial end 54 of the spring housing 50, wherein the landing cap 52 is configured to make contact with a hard stop or hard shoulder 26, for example, as illustrated in FIG. 2. As illustrated in FIG. 6, in certain embodiments, a sealing ring (e.g., o-ring) 56 may be used between the landing cap 52 and the spring housing 50 to isolate the hydraulic fluid 28 from the drilling mud within the drill pipe 16. In addition, as also illustrated in FIG. 6, in certain embodiments, a compensator sub 58 may be disposed on an uphole axial end 60 of the spring housing 50. As illustrated in FIG. 6, in certain embodiments, a sealing ring (e.g., o-ring) 62 may be used between the compensator sub 58 and the spring housing 50 to isolate the hydraulic fluid 28 from the drilling mud within the drill pipe 16.

In general, the piston 34 is attached to the central shaft 36 of the downhole tool string 12 and is configured to move axially within the spring housing 50, for example, during an impact with a hard stop or hard shoulder 26, for example, as illustrated in FIG. 2. As such, when the piston 34 moves axially within the spring housing 50 during an impact, the piston 34 moves against the return spring 48, which abuts the landing cap 52 at the opposite axial end of the return spring 48. As the return spring 48 is compressed in this manner, the return spring 48 will generate a restoring force in the opposite axial direction relative to axial movement of the piston 34. During compression of the return spring 48, hydraulic fluid 28 within a first annular hydraulic chamber 30 (e.g. within which the return spring 48 is disposed) formed within the spring housing 50 on a downhole axial side of the piston 34 between the piston 34 and the landing cap 52 will gradually flow into a second annular hydraulic chamber 64 formed within the spring housing 50 on an uphole axial side of the piston 34 between the piston 34 and the compensator sub 58, wherein the second hydraulic chamber is also isolated (e.g., hermetically sealed off) from an exterior of the hydraulic decelerator 24.

Once the energy from the impact has been completely dissipated, the restoring force generated by the return spring 48 will gradually force the piston back into its original axial position, thereby causing the hydraulic fluid 28 to flow back into the first hydraulic chamber 30 from the second hydraulic chamber 64. Because the restoring force provided by the return spring 48 linearly increases with displacement according to Hooke's law $F=kx$ (where F is the axial spring force of the return spring 48 against the piston 34, k is the stiffness constant of the return spring 48, and x is axial displacement of the piston 34 against the return spring 48, in this scenario), the return spring 48 may also improve the ability to decelerate the downhole tool string 12 towards the end of the stroke where the velocity of the hydraulic fluid 28 is relatively low and the energy dissipation of the hydraulic fluid 28 is relatively small (as previously discussed).

For the purposes of improved tool deceleration performance, the return spring 48 should therefore be stiff enough to support the full weight of the downhole tool string 12. However, for the purpose of a drill pipe-conveyed logging tool string 12, using a return spring 48 stiff enough to support the weight of the downhole tool string 12 adds a risk that the downhole tool string 12 will "bounce" against the return spring 48 during logging operations, which is not ideal. The embodiments described herein, therefore, contemplate the use of a relatively weak return spring 48, just barely strong enough to overcome sliding seal friction and the friction of the outer sleeve 32 of the hydraulic decelerator 24 with the drill pipe 16.

In addition, to eliminate the need to refill the hydraulic decelerator 24 with hydraulic fluid 28, in certain embodiments, the hydraulic decelerator 24 may have another sealed chamber on the uphole axial side of the piston 34, where the metered hydraulic fluid 28 (e.g., flowing between the hydraulic chambers 30, 64) may be retained as it flows past the piston 34. In certain embodiments, a pressure compensator may be used to keep the internal pressure of the hydraulic fluid 28 equalized with the external pressure within the drill pipe 16, and to compensate for variations in volume of the hydraulic fluid 28 that are caused due to temperature and/or pressure variations between the hydraulic chambers 30, 64. In addition, in certain embodiments, an additional return spring 48 may be disposed within the second hydraulic chamber 64.

Figure 7:
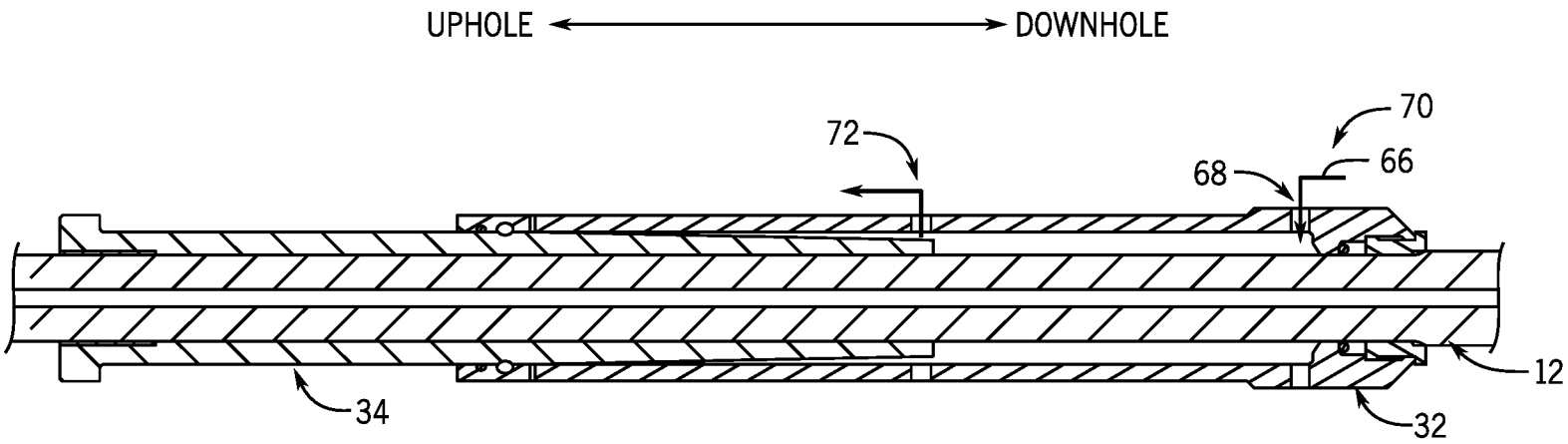
FIG. 7 is a cutaway side view of a mud-based (e.g., vented) hydraulic decelerator that enables variable metering of mud/water through the hydraulic decelerator, in accordance with embodiments of the present disclosure.

In other embodiments, drilling mud or other fluid pumped through the drill pipe 16 may be used instead of separate hydraulic fluid 28 disposed within the hydraulic decelerator 24 as the working fluid for dissipating the kinetic energy of impact with a hard stop or hard shoulder 26, for example, as illustrated in FIG. 2. FIG. 7 is a cutaway side view of a mud-based (e.g., vented) hydraulic decelerator 24 that enables variable metering of mud/water 66 through the hydraulic decelerator 24. As illustrated in FIG. 7, in certain embodiments, the piston 34 may be relatively long axially and may have an outer diameter that is tapered (e.g., either linearly or non-linearly), as opposed to having a tapered inner diameter of the outer sleeve 32, as described above. In the illustrated embodiment, mud/water 66 disposed within the drill pipe 16 may be allowed into the hydraulic chamber 30 formed between the outer sleeve 32 of the hydraulic decelerator 24 and the downhole tool string 12 through one or more inlet ports 68 through the outer sleeve 32 near a downhole axial end 70 of the outer sleeve 32 and may exit from the hydraulic chamber 30 through one or more outlet ports 72 through the outer sleeve 32 that are uphole axially relative to the one or more inlet ports 68 along the outer sleeve 32. As will be appreciated, as the tapered piston 34 moves axially downhole relative to the outer sleeve 32 during impact, as described herein, the flow area between the tapered piston 34 and the outer sleeve 32 will gradually decrease until flow through the one or more outlet ports 72 is ultimately blocked. The main advantage of such an embodiment is that it requires less sophisticated sealing and no pressure compensation. However, a few disadvantages include greater variability in fluid viscosity (depending on which type of drilling mud is pumped) and the potential for internal corrosion from trapped fluid.

It will be appreciated that any and all of the features of the various embodiments of the hydraulic decelerator 24 described herein may be combined in other embodiments. For example, in certain embodiments, both the inner diameters of the outer sleeves 32 described herein and the outer diameters of the pistons 34 described herein may be tapered (e.g., either linearly or non-linearly) to modify the flow area during impact.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

The invention claimed is:

1. A hydraulic downhole tool deceleration system, comprising:

a hydraulic decelerator configured to be affixed to a downhole tool string pumped down through drill pipe during operation, wherein the hydraulic decelerator is configured to contact a hard shoulder while traveling through the drill pipe, and to limit an initial magnitude of deceleration of the downhole tool string caused at an initial moment of contact of the hydraulic decelerator against the hard shoulder, wherein the hydraulic decelerator comprises a piston affixed to the downhole tool string radially about an outer diameter of the downhole tool string and an outer sleeve disposed radially about the piston, wherein a first hydraulic chamber is formed between the outer sleeve and the piston, wherein the first hydraulic chamber is filled with hydraulic fluid, and wherein axial movement of the piston relative to the outer sleeve causes the hydraulic fluid to flow out of the first hydraulic chamber after the outer sleeve contacts the hard shoulder.

2. The hydraulic downhole tool deceleration system of claim 1, wherein the hydraulic decelerator is configured to vary a rate of deceleration of the downhole tool string over time after the initial moment of contact of the hydraulic decelerator against the hard shoulder.

3. The hydraulic downhole tool deceleration system of claim 1, wherein the piston and the outer sleeve form one or more orifices between an outer surface of the piston and an inner surface of outer sleeve that allow the hydraulic fluid to flow out of the first hydraulic chamber as the piston moves axially relative to the outer sleeve.

4. The hydraulic downhole tool deceleration system of claim 3, wherein the one or more orifices are formed on an inner surface of the outer sleeve.

5. The downhole tool hydraulic decelerator of claim 3, wherein each of the one or more orifices are formed by one or more internal grooves that extend axially along the inner surface of the outer sleeve.

6. The downhole tool hydraulic decelerator of claim 5, wherein the one or more internal grooves comprise a first internal groove and a second internal groove, wherein the first internal groove extends axially along the inner surface of the outer sleeve farther than the second internal groove.

7. The hydraulic downhole tool deceleration system of claim 3, wherein the one or more orifices are formed on an outer surface of the piston.

8. The hydraulic downhole tool deceleration system of claim 1, wherein the outer sleeve has a tapered inner surface relative to an outer surface of the piston, wherein the tapered inner surface varies both a pressure in the first hydraulic chamber and a flow area for the hydraulic fluid to flow as the piston moves axially relative to the outer sleeve.

9. The hydraulic downhole tool deceleration system of claim 1, wherein the piston has a tapered outer surface relative to an inner surface of the outer sleeve, wherein the tapered outer surface varies both a pressure in the first hydraulic chamber and a flow area for the hydraulic fluid to flow as the piston moves axially relative to the outer sleeve.

10. The hydraulic downhole tool deceleration system of claim 1, wherein the outer sleeve is directly coupled to the downhole tool string prior to contact with the hard shoulder.

11. The hydraulic downhole tool deceleration system of claim 1, wherein a second hydraulic chamber is formed between the outer sleeve and the piston, and wherein axial movement of the piston relative to the outer sleeve causes the hydraulic fluid to flow out of the first hydraulic chamber and into the second hydraulic chamber after the outer sleeve contacts the hard shoulder.

12. The hydraulic downhole tool deceleration system of claim 11, comprising a pressure compensator configured to compensate for variations in volume of the hydraulic fluid that are caused due to temperature and/or pressure variations between the first and second hydraulic chambers.

13. The hydraulic downhole tool deceleration system of claim 11, comprising a first return spring disposed within the first hydraulic chamber, wherein the first return spring forces the piston to return to an initial axial position relative to the outer sleeve after energy from the contact with the hard shoulder has dissipated.

14. The hydraulic downhole tool deceleration system of claim 13, wherein the first return spring is preloaded to compensate for friction between the outer sleeve and the drill pipe and for friction between the outer sleeve and the downhole tool string.

15. The hydraulic downhole tool deceleration system of claim 1, wherein the hydraulic fluid has shear thinning properties.

16. The hydraulic downhole tool deceleration system of claim 1, comprising a valve in the piston, wherein the valve is configured to facilitate flow of the hydraulic fluid from the first hydraulic chamber.

* * * * *